United States Patent [19]

Peill

[11] 4,252,501

[45] Feb. 24, 1981

[54] HOLLOW COOLED VANE FOR A GAS TURBINE ENGINE

[75] Inventor: Peter G. Peill, Hamilton, Canada

[73] Assignee: Rolls-Royce Limited, London, England

[21] Appl. No.: 524,478

[22] Filed: Nov. 14, 1974

[30] Foreign Application Priority Data

Nov. 15, 1973 [GB] United Kingdom ..... 52985/73

[51] Int. Cl.[3] ..... F01D 5/18

[52] U.S. Cl. ..... 415/115; 416/96 A; 416/97 R

[58] Field of Search ..... 415/115, 116; 416/90, 416/95, 96, 232, 233, 96 R, 96 A

[56] References Cited

U.S. PATENT DOCUMENTS

| | | | |
|---|---|---|---|
| 3,540,810 | 11/1970 | Kercher | 416/90 |
| 3,628,880 | 12/1971 | Smuland et al. | 415/115 |
| 3,781,129 | 12/1973 | Aspinwall | 415/115 |
| 3,806,275 | 4/1974 | Aspinwall | 415/115 |

*Primary Examiner*—Stephen C. Bentley

*Attorney, Agent, or Firm*—Cushman, Darby & Cushman

[57] ABSTRACT

A hollow cooled vane for a gas turbine engine comprises at least two apertured members each mounted spaced from a separate part of the vane interior surface. The first of these members is provided with a supply of cooling air which passes through the apertures in the form of jets to impingement cool the respective first surface, and an interconnecting passage is provided to take this air to the second apertured member where it impingement cools the respective second surface.

11 Claims, 6 Drawing Figures

HOLLOW COOLED VANE FOR A GAS TURBINE ENGINE

Figure 1:
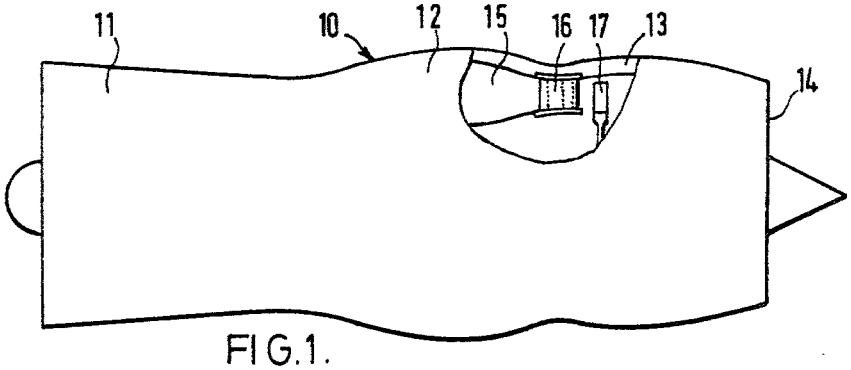

This invention relates to a hollow cooled vane for a gas turbine engine.

Throughout this specification the term 'vane' is to be understood to include within its scope stator blades, aerodynamic struts, and rotor blades, all for use in turbines or compressors or other parts of the engine.

In gas turbine engines it is common to manufacture various of the parts, particularly the turbine vanes and blades, so that they may be cooled by the flow of a cooling fluid, normally air, through and within their hollow interiors. The use of this cooling fluid represents a penalty which subtracts from the thrust available from the engine; consequently it is important that the cooling fluid be used in as efficient a manner as possible.

One known way of cooling the hollow vanes is to cause the cooling fluid to flow through apertures in a member in the form of jets which impinge on an interior surface of the blade; this 'impingement' cooling provides an efficient use of cooling fluid particularly in those areas where the temperature is somewhat less than the highest to be experienced. The present invention provides a way in which a single flow of cooling fluid may be used to provide sequential impingement cooling of two areas of the vane.

Throughout this specification references to an interior surface of the vane are to be understood to include all those surfaces of the vane not exposed to the gas flow of the engine, and specifically includes the surfaces of the shrouds and/or platforms of the vane remote from the gas flow of the engine.

According to the present invention a hollow cooled vane for a gas turbine engine comprises at least two apertured members each supported spaced from a separate part of the vane interior surface, the first of said apertured members being adapted to be fed with cooling air from the exterior of the vane and to cause said air to flow through its apertures in the form of jets to impinge on and cool the respective first part of the vane interior surface and interconnecting passage means being provided to cause the air which has impinged on said first part of the vane interior surface to flow to said second apertured member and to flow through the apertures therein in the form of jets to impinge on and cool the respective second part of the vane interior surface.

Said first apertured member may be supported spaced from the surface of the shroud or platform of the vane remote from the gas flow of the engine, in which case said second apertured member may comprise an air entry tube mounted within the hollow interior of the aerofoil section of the blade.

Alternatively the first said apertured member may comprise an air entry tube which may be a complete tube or may be an incomplete tube which is completed by part of the vane wall to which it is sealed, and the cooling fluid may be fed from outside the vane to the interior of this tube.

Said second apertured member may comprise an apertured tube and the sole supply of cooling fluid to the interior of the apertured tube may be from said air entry tube.

Additional to the cooling of the vane performed by the impingement cooling mentioned above, the vane may be provided with drillings from its interior to its exterior surface through which cooling fluid may flow to provide film cooling. In this case it may be desirable to allow cooling fluid from the air entry tube direct access to the film cooling holes adjacent the leading edge by using that part of the vane as part of the air entry tube.

Figure 2:
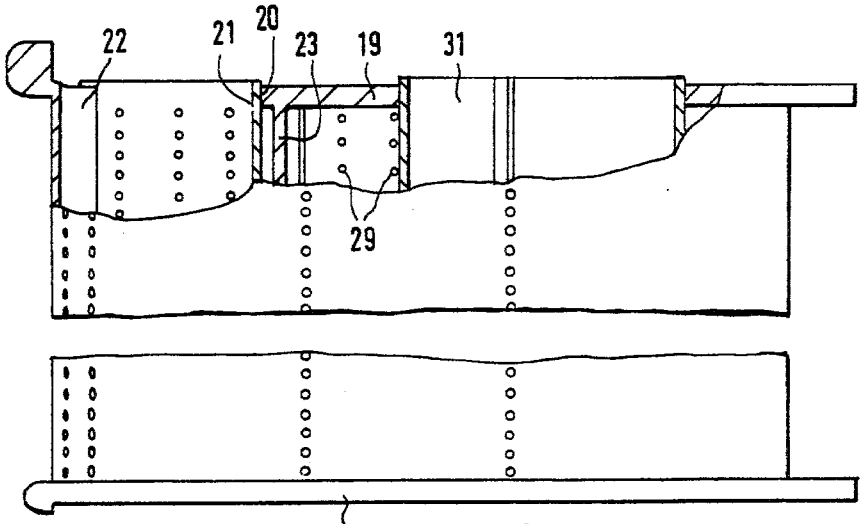
Figure 3:
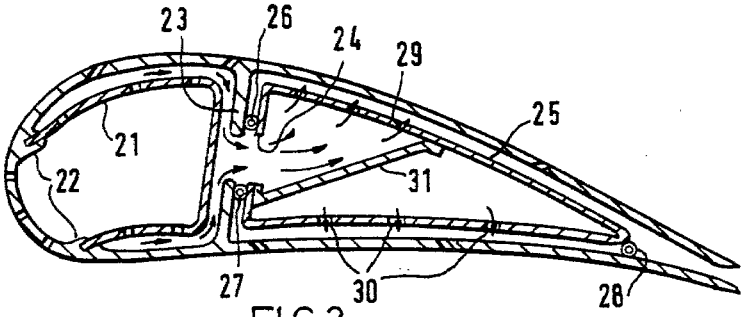
Figure 4:
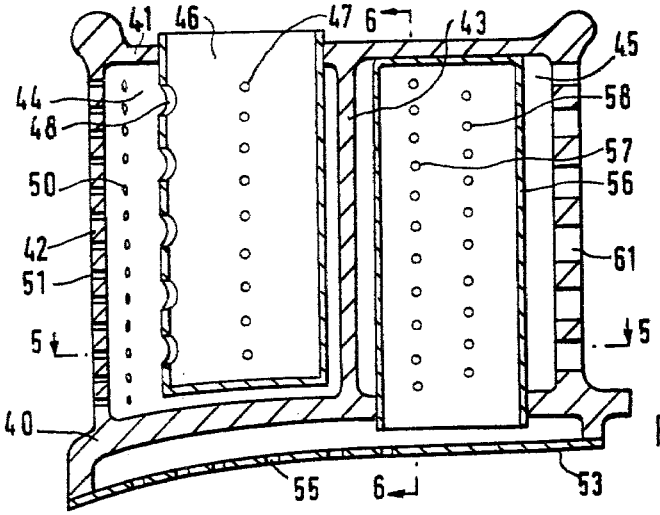
Figure 5:
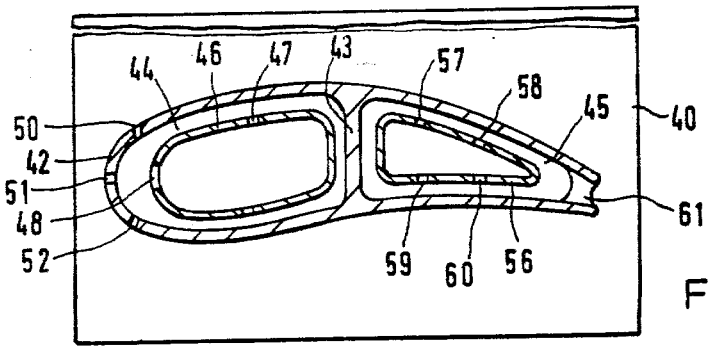
Figure 6:
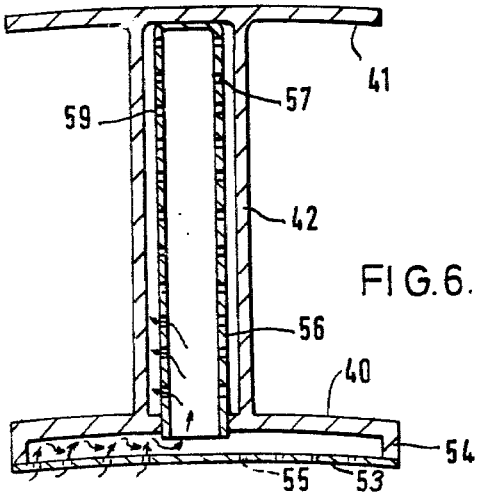

The invention will now be particularly described, merely by way of example, with reference to the accompanying drawings in which:

FIG. 1 is a side elevation of a gas turbine engine whose casing is partly broken-away to show vanes in accordance with the invention, FIG. 2 is an enlarged side view, partly broken away, of the vane of FIG. 1, FIG. 3 is a section on the line 2—2 of FIG. 2, showing the section of a vane, FIG. 4 is a view similar to FIG. 2 but of a further embodiment, FIG. 5 is a section on the line 5—5 of FIG. 4, and FIG. 6 is a section on the line 6—6 of FIG. 4.

In FIG. 1 there is shown a gas turbine engine comprising a casing 10 which encloses a compressor 11, combustion section 12, turbine 13 and final nozzle 14 all in flow series. The casing at the downstream end of the combustion section is broken away to make visible the combustion chamber 15 and the nozzle guide vanes 16 which direct gases from the chamber on to the rotor blades 17 of the turbine. FIG. 2 shows one of the vanes 16 enlarged and partly broken away to show some detail of the interior. It will be seen that the vane comprises an aerofoil section working portion which is formed integrally with inner and outer shroud portions 18 and 19 respectively. The outer shroud portion 19 is provided with an aperture 20 in its leading section to which a supply of compressed cooling air is provided from the compressor section 11.

Within and sealed to the periphery of the aperture 20 fits a cooling air entry tube 21; this tube extends longitudinally through the vane and is sealed at its inner end to the inner shroud 18. As can best be seen from FIG. 3, although the tube 21 is described as a tube, it is not in fact a complete tube but comprises a U-section, the limbs of which are sealed and retained into grooves in ridges 22 which extend longitudinally from the blade interior surface adjacent the leading section of the blade. The U-section of the tube 21 is thus completed by the area of the leading edge between the ridges 22 to form a complete tube.

The remaining section of the tube comprises the limb portions of the U-section which are substantially constantly spaced from the flank parts adjacent the leading edge, and a rear section. The limb portions are apertured to allow air to flow from the interior of the tube to impinge on the inner surfaces of the blade, while the leading edge portion of the blade between the ridges 22 is provided with film cooling holes which allow cooling air to flow to the outer surface of the vane to provide film cooling.

The forward section of the vane in which is housed the tube 21 is separated from the rearward section by an apertured web 23, the apertures of which correspond with the apertures 24 in the forwardly facing surface of a second tube 25. This tube conforms to the interior shape of the trailing edge section of the vane and is mounted so as to have its outer surface substantially constantly spaced from the inner vane surface by springy tubes 26, 27 and 28. These tubes extend longitudinally of the vane and provide sealing between the tube and the vane as well as locating the tube inside the vane, although it may be desirable to provide further location features.

In addition to the apertures 24 the tube 25 is provided with apertures 29 and 30 in those walls of the tube which extend adjacent the convex and concave flanks of the vane respectively. In this particular embodiment a partition 31 is also provided within the tube 25, sealing that section of the tube which supplies air to the apertures 29 from that section which supplies air to the apertures 30. As can best be seen from FIG. 2, that section of the tube 25 which supplies air to the apertures 30 is provided with a direct feed of cooling air from outside the outer shroud 19. Thus the half-tube formed between the partition 31 and the wall of the tube 25 which provided with apertures 30 is arranged to project through the shroud 19 to take up cooling air directly. The other end of the tube is sealed to the inner shroud portion 18.

Once again, film cooling holes are provided in both concave and convex flanks of the trailing edge portion of the vane so that film cooling of this portion may also be effected; these holes are not enumerated since they are not central to the present invention.

At the trailing edge itself of the vane there is provided an air exhaust slot which extends completely along the trailing edge of the vane and through which any remaining cooling air exhausts to atmosphere.

Operation of the cooling system of the vane is as follows: cooling air from the compressor enters the tube 21 and flows down it, exhausting via the film cooling holes in the leading edge section between the ribs 22 and via the sets of apertures in the tube itself. The air which exhausts from the film cooling holes provides film cooling of the leading edge in the normal manner; it will be noted that these holes have direct access to the air as soon as it enters the vane and thus the best use is made of the pressure available to film cool at the leading edge, where the ambient gas pressure is at its highest.

Air flowing through the apertures in the tube is caused by the size and disposition of the apertures to flow in the form of jets which impinge on the inner surface of the vane to provide impingement cooling; this air although reduced in pressure by its passage through the apertures is of sufficient pressure to flow through the film cooling holes in the adjacent portions of the vane to provide film cooling. Only a small proportion of the available air is used to provide film cooling, the remainder flowing between the tube and the vane interior through the apertures in the web 23 and through apertures 24 into the tube 25. Here the air passes through apertures 29 to impinge on and thus cool the trailing edge part of the convex flank of the vane. A separate intake of cooling air through the outer shroud 19 flows through the apertures 39 to impingement cool the trailing edge part of the concave flank of the vane. As in the case of the leading edge, air flows through film cooling holes to provide additional film cooling of the surfaces. In the case of the air flowing through apertures 30 the seals formed by the resilient tubes 27 and 28 prevent the air from escaping from the space between the vane and the tube 25 by any route other than through the film cooling holes; consequently the complete flow through the apertures 30 exhausts through the film cooling holes, and the pressure of this air may be arranged to be different from that which exhausts through the trailing edge.

The air which passes through the apertures 20 on the opposite side of the vane, however, can flow between the tube 25 and vane interior surface to the rear of the vane and can escape through the trailing edge slot 32; thus only a proportion of the air which passes through the apertures 29 passes through the film cooling holes to film cool the trailing portion of the convex flank.

FIGS. 4–6 show a further embodiment in which the two locations at which impingement cooling is successively provided by the same flow of air, are located one on the inner shroud of the blade and one inside the hollow interior of the aerofoil.

It will be seen that the vane is externally similar to that of the previous embodiment, comprising an inner shroud 40, an outer shroud 41 and an aerofoil section portion 42. The aerofoil section is hollow and divided by a web 43 into forward and rearward compartments 44 and 45. The forward compartment is provided with an air entry tube 46 which extends from the surface of the shroud 41 distant from the gas flow, where it communicates with a source of cooling air, and is blanked off at its other end adjacent the inner shroud 40.

Rows of orifices 47, 48 and 49 are provided in the tube 46 which allow the cooling air to flow in the form of jets against the interior surface of the forward compartment 44 to provide impingement cooling, and the air then flows through drillings 50, 51 and 52 to the exterior surface of the blade to provide film cooling of the surface. Thus the cooling of the forward section of the blade is quite conventional.

In this embodiment the inner shroud 40 is provided with cooling; thus an impingement plate 53 is sealed to a peripheral rib 54 from the face of the shroud away from the gas flow, and is spaced therefrom by a constant small distance. Apertures 55 are provided in the plate, and as in the case of the tube 46 these are sized so that a flow of cooling air from a source not shown passes through the apertures 54 in the form of jets which impinge on the surface of the shroud 40 to provide impingement cooling.

The air which has impinged on the shroud surface then flows into a rearward air entry tube 56 which is located within and substantially conforms with the interior shape of the rearward compartment 45 of the vane.

The tube 56 is blanked off at its end adjacent the shroud 41; as inferred above its other end extends into and is open to the space between the plate 53 and shroud 40 so that it can pick up the cooling air which has impinged on the shroud surface.

The tube 56 is provided with rows of apertures 57, 58, 59 and 60 which again are sized to allow the cooling air to flow as jets which impinge on the inner surface of the rearward compartment 45. The spent air then flows out of the vane through trailing edge slots 61, providing further cooling of the trailing edge.

This second embodiment, therefore, uses one flow of air to provide impingement cooling on the shroud and in the hollow inside of the vane, both these areas being according to our definition interior surfaces of the vane.

It will therefore be seen that the invention enables a single flow of cooling air to be used twice over to provide a high degree of impingement cooling at one location and a lesser degree at a second location, although the cooling at the two locations could be arranged to be similar, or to be greater at the second location. It also in the first embodiment, provides a high initial pressure and subsequently lower pressures towards the trailing edge of the vane which makes it easy to provide film cooling air at the correct pressure and which uses the cooling potential of the air over the whole blade section.

It should be noted that the constructions above are two of a number of potential ways of applying the present invention. Instead of using two tubes as the apertured members, other devices such as discrete plates or webs could be used; in this way it would be possible to successively cool two or more areas of the vane. The construction could obviously be used for more than two areas in succession. The cooled areas need not include the complete vane; it would be possible to use this construction to provide cooling for e.g. the central section of the vane, the other portions being cooled by other methods.

Again, although described in its application to a vane the invention could clearly be used for rotor blades or struts or other aerofoil gas-contacting member.

I claim:

1. A hollow cooled vane for a gas turbine engine comprising at least two apertured members each supported spaced from a separate part of the vane interior surface, the first of said apertured members being adpated to be fed with cooling air from the exterior of the vane, the apertures in said member allowing the air to flow through it in the form of jets which impinge on and cool the respective first part of the vane interior surface, and interconnecting passage means being provided to cause the air which has impinged on said first part of the vane interior surface to flow to said second apertured member and to flow through the apertures therein in the form of jets which impinge on and cool the respective second part of the vane interior surface.

2. A hollow cooled vane as claimed in claim 1 and in which said first and second apertured members comprise air entry tubes.

3. A hollow cooled vane as claimed in claim 2 and in which the vane has a hollow aerofoil section, said air entry tubes being located in the forward and rearward portions of the hollow aerofoil section of the vane.

4. A hollow cooled vane as claimed in claim 3 and in which there is an apertured web which divides the interior of the hollow aerofoil section of the vane into said forward and rearward portions, the apertures in the web being aligned with and sealed to corresponding apertures in the second air entry tube and comprising said interconnecting passage.

5. A hollow cooled vane as claimed in claim 3 and in which the forward air entry tube comprises a part tube sealed to the forward portion of the vane interior so that this portion completes the tube, said forward portion being provided with drillings through which cooling air may flow to film cool part of the exterior surface of the blade.

6. A hollow cooled vane as claimed in claim 3 and in which the second air entry tube is divided into two longitudinally extending parts, one of which is fed with cooling air after it has impinged on said first part of the vane interior surface and the second of which is fed directly with cooling air from the exterior of the vane.

7. A hollow cooled vane as claimed in claim 1 and in which said vane comprises a shroud having a surface away from the gas flow of the engine, and said first apertured member comprises an impingement cooling plate mounted spaced from said surface.

8. A hollow cooled vane as claimed in claim 7 and in which said second apertured member comprises an air entry tube.

9. A hollow cooled vane as claimed in claim 8 and comprising a hollow aerofoil section whose interior is divided into separate forward and rearward portions, one air entry tube being mounted in each of said portions and said second apertured member being the rearmost one of said tubes.

10. A hollow cooled vane as claimed in claim 9 and in which the air entry tube mounted in the forward compartment is provided with a direct feed of cooling air from the exterior of the vane.

11. A hollow cooled vane as claimed in claim 9 and in which said rearmost air entry tube projects into the space between the impingement plate and the shroud so as to obtain its supply of cooling air.

* * * * *